United States Patent [19]

Pemberton et al.

[11] 3,972,580

[45] Aug. 3, 1976

[54] ELECTRICAL TERMINALS

[75] Inventors: Donald Stuart Pemberton, Stoke-on-Trent; Gordon Roy Frank Smith, Newcastle-under-Lyme, both of England

[73] Assignee: Rist's Wires & Cables Limited, Birmingham, England

[22] Filed: Dec. 13, 1974

[21] Appl. No.: 532,382

[30] Foreign Application Priority Data

Dec. 28, 1973 United Kingdom..... 59967/73

[52] U.S. Cl...... 339/47 R

[51] Int. Cl.[2]..... H01R 11/16

[58] Field of Search..... 339/47 R, 49 R, 256 SP, 339/258 S

[56] References Cited

UNITED STATES PATENTS

| | | | |
|---|---|---|---|
| 2,735,998 | 2/1956 | Martines | 339/258 S |
| 3,146,051 | 8/1964 | Woofter et al. | 339/49 R X |
| 3,644,872 | 2/1972 | Russo, Jr. | 339/256 SP X |
| 3,688,243 | 8/1972 | Yamada et al. | 339/49 R |
| 3,789,343 | 1/1974 | Hirokawa et al. | 339/49 R |

*Primary Examiner*—Joseph H. McGlynn
*Assistant Examiner*—Howard N. Goldberg
*Attorney, Agent, or Firm*—Holman & Stern

[57] ABSTRACT

An electrical terminal which is formed from sheet metal, and which includes a socket connector, a blade connector, and a resilient member which extends within the socket connector. The blade connector is integral with, and extends from the socket connector, and the resilient member is also integral with the socket connector and extends within the socket connector. The terminal is arranged to mate with a second identical terminal, and when two such terminals are mated the blade connector of the second terminal is received in the socket connector of the first terminal and is gripped therein between the wall of the socket connector and said resilient member. The socket connector of the second terminal similarly receives and grips the blade connector of the first terminal.

3 Claims, 6 Drawing Figures

ELECTRICAL TERMINALS

This invention relates to electrical terminals particularly but not exclusively terminals intended to be physically and electrically connected to a conductive lead.

An electrical terminal according to the invention is formed from sheet conductive material and includes, a socket connector, a blade connector integral with and extending from said socket connector, and a resilient member extending within said socket connector, the terminal being arranged to mate with a second identical terminal, the blade connector of the second terminal being received in the socket connector of the first terminal and being gripped therein between the wall of said socket connector and said resilient member and the socket connector of the second terminal similarly receiving and gripping the blade connector of the first terminal.

Preferably the resilient member is integral with the blade and socket connectors, the member and the connectors being defined by respective regions of the common blank.

Figure 1:
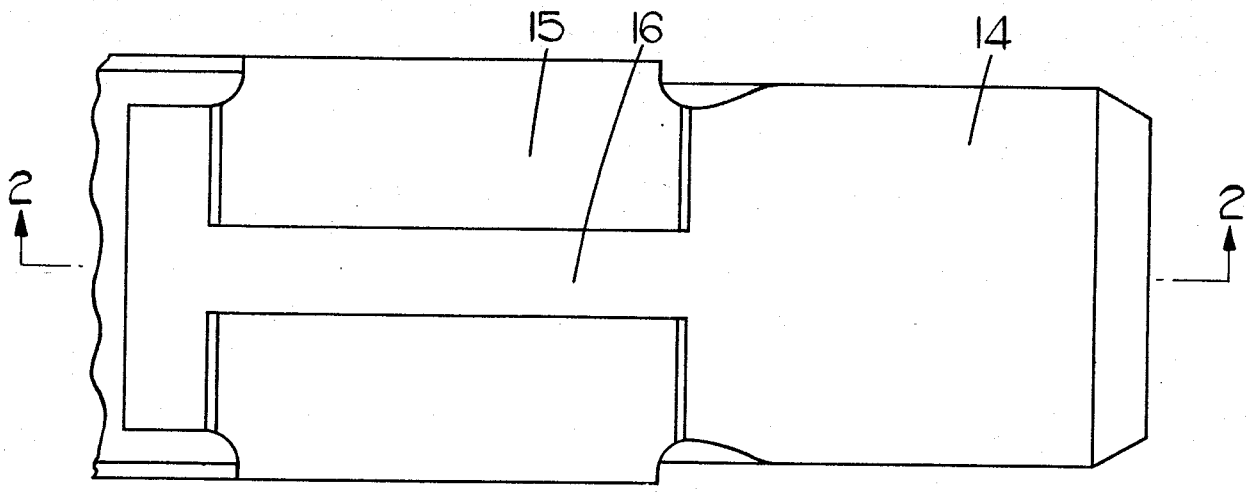
Figure 2:
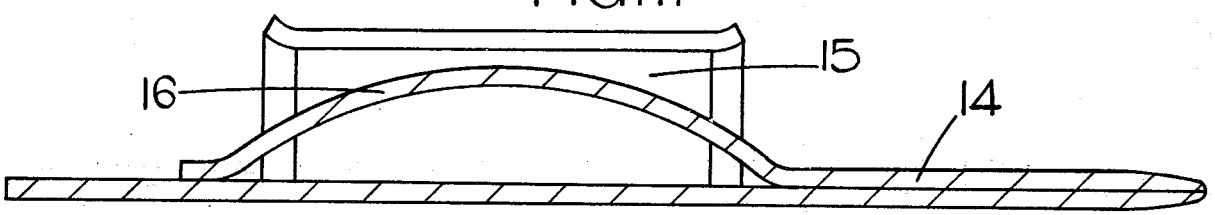
Figure 4:
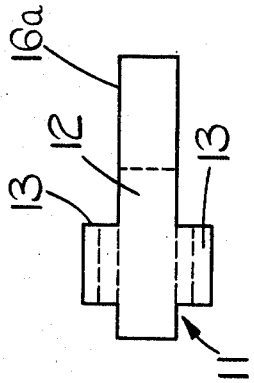
Figure 3:
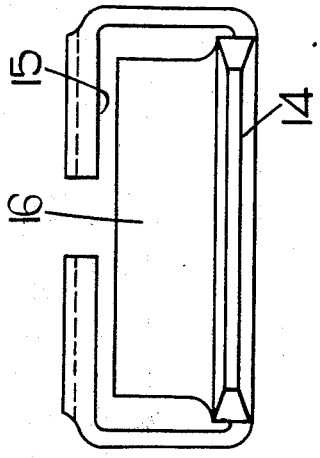
Figure 5:
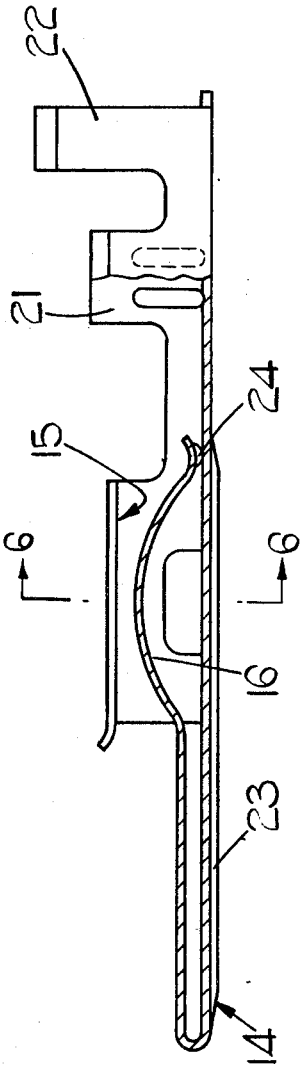

One example of the invention is illustrated in the accompanying drawings wherein, FIG. 1 is a plan view of an electrical terminal, FIG. 2 is a sectional view on the line 2—2 in FIG. 1, FIG. 3 is an end view of the terminal shown in FIG. 1, FIG. 4 is a sketch, to a reduced scale, showing approximately the form of the sheet metal blank from which the terminal shown in FIGS. 1 to 3 is constructed, FIG. 5 is a sectional view of a modification of the terminal shown in FIGS. 1 to 4, and FIG. 6 is a sectional view on the line 6—6 in FIG. 5.

Referring first to FIGS. 1 to 4 of the drawings, the electrical terminal is formed from a single sheet brass blank 11 stamped from a large brass sheet. The blank 11 is generally in the form of an elongate strip 12 having a pair of oppositely directed lateral wings 13 adjacent one end thereof. The blank is folded along the dotted lines shown in FIG. 4 to produce the hermaphrodite terminal shown in FIGS. 1 to 3. The terminal includes a blade connector 14, a socket connector 15 and a resilient tongue 16 extending within the socket connector 15. The terminal is formed from the blank 11 in the following manner. The blank 11 is stamped from a sheet of brass, and the strip like portion 12 remote from the wings 13 is formed with abowed region 16*a* the strip 12 is then bent intermediate the bowed region 16*a* and the wings 13 so that the bowed region 16*a* lies adjacent the wings 13, and is bowed upwardly away from the underlying part of the strip 12. Adjacent the bend in the strip 12 the two regions of the strip 12 lie in facial contact, to define the blade connector 14 of double thickness. The wings 13 are bent to lie at right angles to the strip 12, and then are bent again intermediate their free endges and the strip 12 to extend towards one another, and so define a socket connector containing the bowed portion 16*a* of the strip. Thus the wings 13 in their final form include portions extending at right angles to the strip and defining side walls of the socket connector 15, and further portions extending towards one another, parallel to the strip, and overlying the strip to define an upper surface of the socket connector. The bowed portion 16*a* of the strip lying within the socket connector 15 defines the resilient member 16, the bowing of the member 16 being such that in the rest, unstressed condition of the member 16 the clearance between the upper surface of the member 16 and the under surface of the top walls of the socket connector is less than the thickness of the blade connector 14.

It will be appreciated that the internal width of the socket connector 15 is substantially equal to the width of the blade connector 14, and so a second identical connector can be engaged therewith. The blade connector 14 of the second, identical connector is received in the socket 15 of the first connector, and since its thickness is greater than the clearance between the resilient member 16 and the adjacent wall of the socket connector then the blade connector 14 of the second terminal will be gripped within the socket connector 15 by the resilient member 16. Similarly, the blade connector 14 of the first terminal is received in the socket connector of the second terminal, and gripped therein by the resilient member of the second terminal.

Assuming that the two identical terminals are physically and electrically connected to individual electrical leads, then when the two terminals are mated the electrical leads will be electrically interconnected both by the engagement of the blade connector 14 of the first terminal in the socket connector of the second terminal, and by the engagement of the blade connector of the second terminal in the socket connector 15 of the first terminal.

The terminal construction described above has several advantages. Firstly, in order to produce an electrical connection between two leads it is necessary only to produce a single form of terminal member. Secondly, since the terminal member is formed from strip material, and there are two regions of contact when two terminal members are mated, then there is a relatively high electrical contact area between the two terminals. Since the contact area is high, then the contact pressure which is required is correspondingly low, and thus engagement and disengagement of the two terminal members is relatively easy.

It will be appreciated that the terminal member can be physically and electrically connected to an electric lead in any desired manner. For example, the end of the strip like portion 12 of the blank adjacent the wings 13 can be formed integrally with two pairs of deformable tags, the first pair of tags being deformable in use to physically grip the insulating sheath of the lead, and the second pair of tags being deformable in use to grip and make electrical contact with the bared core of the lead. Alternatively of course some form of screw clamping could be provided at the end of the strip like portion 12 adjacent the wings 13.

Moreover, it is to be appreciated that it is not essential that the terminal be utilised in conjunction with an electric lead. If desired, the terminal could be incorporated into the body of an electrical component, so as to make direct electrical connection with for example electrical contacts in the component. In such an arrangement, the component could be "plugged into" a similar component provided with identical terminals.

In a modification the resilient member 16 of the terminal is not integral with the remainder of the terminal, and is defined by a separate sheet metal pressing secured in the socket in any convenient manner. For example, the resilient member can be a bowed pressing having four arms extending therefrom, the four arms being bent around respective edges of the socket to retain the resilient member within the socket.

Figure 6:
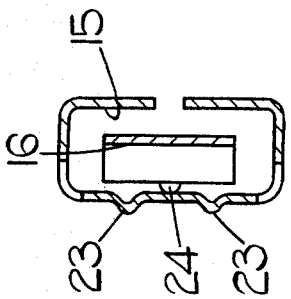

In the further modification shown in FIGS. 5 and 6 the terminal is again formed from a single sheet brass blank, the assembly being similar to that described with reference to FIG. 4. The terminal is formed integrally with two pairs of deformable tags 21, 22 the tags 22 in use being deformed to grip the sheath of an electric lead, and the tags 21 being deformed to grip a bared portion of the conductive core of the lead, the tags 21, 22 ensuring that the terminal is both physically and electrically connected to the respective lead.

The terminal differs from that described above in that the two thicknesses of the blade connector 14 thereof are not in facial contact. Thus the bend in the strip which defines the blade connector 14 is of a sufficiently large radius that the two thicknesses of the blade connector 14 although extending parallel to one another are spaced apart. It has been found that this form of blade connector can be produced more consistently on a mass production basis than the form of blade connector shown in FIG. 2 where the two thicknesses are in facial contact. However, in order to enhance the stiffness of the blade connector one thickness thereof is provided with longitudinally extending ribs 23 which are stamped into the blank during formation of the blank. The ribs 23 extend from the free end of the blade connector 14 along the one thickness thereof to the remote end of the socket connector 15.

In addition to the modification to the blade connector 14, the free end of the resilient tongue 16 is formed with a projection 24 which spaces the free end of the resilient tongue 16 from the base of the socket connector 15. The projection 24 is stamped into the blank during formation of the blank, and in the finished terminal the tongue 16 can twist along its length, pivoting about the point of contact of the projection 24 and the base of the socket connector 15, to accommodate misalignment of the socket connector and a blade connector inserted therein. The tongue 16 thus engages a misaligned blade connector in facial rather than edge contact so minimising the blade connector to tongue contact area of a mated pair of terminals.

It is to be understood that the blade connector, and resilient tongue form described with reference to FIGS. 5 and 6 can be utilised in any of the possible versions of the terminal member, and are not limited to use in the form of terminal member incorporating deformable tags 21, 22.

Any of the terminals described above can find use in a plug and socket type connector where a plurality of terminals are used in each component of the plug and socket connector. Such connectors are known as multi-way connectors, and owing to the low contact pressure of the terminal, and therefore the ease with which terminals can be engaged and disengaged a very large number of terminals can be used in the plug and socket connector without the need for any mechanical means to aid interconnection, and disengagement of the two parts of the plug and socket connector.

We claim:

1. An electrical terminal formed from sheet conductive material and including a socket connector, a blade connector integral with and extending from said socket connector, and a resilient member of strip-like form extending within said socket connector, said member being secured at one end to the terminal, and being capable of being flexed towards an inner wall of the socket connector, the other end of said resilient strip-like member being free, and being formed with a generally centrally disposed substantially semi-spherical projection engageable with a surface of the terminal in response to flexure of the member towards said inner wall, engagement of said projection with said surface permitting twisting along the length of the member relative to the socket connector to accommodate misalignment of said socket connector and a mating blade connector in use.

2. An electrical terminal as claimed in claim 1, wherein said surface of the terminal engageable by said substantially semi-spherical projection is the surface of said inner wall of said socket connector.

3. An electrical terminal as claimed in claim 1, wherein said resilient member is integral with the blade and socket connectors, the member and the connectors being defined by respective regions of the sheet conductive material.

* * * * *